US008963427B2

(12) United States Patent
Kühn

(10) Patent No.: US 8,963,427 B2
(45) Date of Patent: Feb. 24, 2015

(54) DEVICE AND METHOD FOR GENERATING A PLASMA

(71) Applicant: Forschungsverbund Berlin E. V., Berlin (DE)

(72) Inventor: Silvio Kühn, Wandlitz (DE)

(73) Assignee: Forschungsverbund Berlin E.V., Berlin (DE)

( * ) Notice: Subject to any disclaimer, the term of this patent is extended or adjusted under 35 U.S.C. 154(b) by 0 days.

(21) Appl. No.: 13/847,523

(22) Filed: Mar. 20, 2013

(65) Prior Publication Data

US 2013/0249398 A1 Sep. 26, 2013

(30) Foreign Application Priority Data

Mar. 20, 2012 (DE) ..... 10 2012 204 447

(51) Int. Cl.
*H05H 1/46* (2006.01)

(52) U.S. Cl.
CPC ..... *H05H 1/46* (2013.01); *H05H 2001/4682* (2013.01)
USPC ..... 315/111.21; 315/39.51; 315/39.53; 315/111.71

(58) Field of Classification Search
CPC ..... H05H 1/46; H05H 1/24; H05H 2001/00; H05H 2001/4622; H05H 6/705; H05H 6/707
USPC ..... 315/39, 39.51, 39.53, 111.21, 111.71
See application file for complete search history.

(56) References Cited

U.S. PATENT DOCUMENTS

| | | | | |
|---|---|---|---|---|
| 3,462,704 | A | 8/1969 | Golombek et al. | |
| 5,131,992 | A | 7/1992 | Church et al. | |
| 5,945,888 | A | 8/1999 | Weinert et al. | |
| 6,362,349 | B1 | 3/2002 | Kuperman et al. | |
| 2002/0127155 | A1* | 9/2002 | Minaee et al. | 422/186 |
| 2007/0171006 | A1 | 7/2007 | DeVincentis | |
| 2009/0295509 | A1* | 12/2009 | Master et al. | 333/219.1 |
| 2012/0086339 | A1* | 4/2012 | Lloyd et al. | 315/111.21 |
| 2012/0285934 | A1* | 11/2012 | Porteanu et al. | 219/121.36 |

FOREIGN PATENT DOCUMENTS

| | | |
|---|---|---|
| DE | 1516909 | 8/1969 |
| DE | 3831453 | 3/1990 |
| DE | 102009046881 | 5/2011 |

* cited by examiner

*Primary Examiner* — Douglas W Owens
*Assistant Examiner* — Thai Pham

(57) ABSTRACT

A device (200) for generating a plasma that comprises a plasma source (241) designed as a hollow space and a resonator (201) that includes a waveguide (211, 212, 2131) and the plasma source (241), wherein the waveguide (212, 213) is operatively connected with the plasma source (241); the device further comprising a first coupling means (231) for energy introduction (251) and a second coupling means (232) for energy extraction (252), wherein each coupling means (231, 232) is in an energy- and signal-carrying (251, 252) operative connection with the waveguide; the device further comprising an active element (261) for energy supply to the resonator (201), operatively connected with the first (231) and the second (232) coupling means, wherein the plasma source (241) is at least partially integrated into a section of the waveguide (211, 212, 213) that extends between the first coupling means (231) and the second coupling means (232).

9 Claims, 2 Drawing Sheets

- PRIOR ART -

DEVICE AND METHOD FOR GENERATING A PLASMA

RELATED APPLICATION

This application claims the benefit of priority of German Patent Application No. 10 2012 204 447.7 filed Mar. 20, 2012, the contents of which are incorporated herein by reference in their entirety.

FIELD AND BACKGROUND OF THE INVENTION

This invention relates to a device and method for generating a plasma.

The subject matter of this invention are plasma processes using microwave capillary discharges and a system suitable for them.

There are many embodiments of plasma waves for vacuum applications, and their development has been driven by the demand for producing ever smaller structures while the plasma should do as little damage as possible to the substrates, and for homogeneous machining of larger and larger surfaces and for short machining times. The core purpose is to achieve an optimum plasma composition for machining and to control it in time and place. In view of the continually rising requirements, there will be an urgent need for further developing plasma sources in the future.

SUMMARY OF THE INVENTION

The disadvantage of prior art is that the standing wave drops when the plasma ignites and that extraction via the coupling means also diminishes until the extracted energy is no longer sufficient to maintain a stable wave with plasma.

It is therefore the object of the invention to improve the actuation of micro-plasma sources for these applications.

According to the invention, a device for generating a plasma is provided that comprises a plasma source shaped like a hollow space and a resonator that includes a waveguide and the plasma source, wherein the waveguide is operatively connected with the plasma source; a device comprising a first coupling means for energy introduction and a second coupling means for energy extraction, each coupling means being in an energy- and signal-carrying and operative connection with the waveguide; a device comprising an active element for energy supply to the resonator that is operatively connected to the first and second coupling means; wherein the plasma source is at least partially integrated into a section of the waveguide that extends between the first coupling means and the second coupling means.

A first line termination is provided on one side of the resonator and still belongs to the resonator. The waveguide is connected to ground there, that is, short-circuited, so that the wave is completely reflected at this spot and changes its direction of propagation. The wave then runs against the plasma and is partially reflected there. A portion of the energy passes into the plasma, the other portion returns with the wave towards the short circuit where another reflection occurs. Yet another portion of the wave goes beyond the plasma towards a second line termination where another reflection occurs. The wave moves to and fro several times and is partially absorbed by the plasma, which corresponds to the effective power dissipated into the plasma. The to-and-fro motion causes a resonance/standing wave with a voltage overshoot in the region of the plasma electrodes.

In the embodiment according to the invention, this wave also runs into the plasma and is partially reflected, absorbed, but in addition also transmitted. This means that a portion of the wave, the transmitted portion, is available for feedback in the oscillator. It is novel that the plasma is actively involved in the feedback in the oscillator and therefore has considerably more influence on the oscillator than is known from prior art.

The advantage of this device is that it improves the performance of the microwave plasma sources with respect to plasma-dependent frequency correction and the feedback required for the oscillator.

Feedback not only takes place via direct coupling with the standing wave of the resonator, but according to the invention via the plasma as well. Since the conductivity of the plasma increases with its ignition, the extent of the feedback increases as well. This represents the core of the invention and the advantage of this oscillator type.

Further advantages result from adjusting the plasma load. Performance, efficiency, stability of oscillation, and reliability are also clearly improved.

Being connected in the above meaning preferably is an operative connection, e.g. by conducting one/several measured variable(s) or state(s). For example, an electrical or magnetic field can be detected, preferably near the plasma or in or at the resonator or at/through a coupling point. In the same way, an electric current and/or electric output could be detected in, at the edge, or near the functional elements mentioned above, and the elements for detection could be located there and/or away from the place of detection due to conduction of the physical variables. A dynamic and/or static pressure can also be detected in the area of the plasma source. It is also possible to exert optical control over the plasma using a glass fiber cable and preferably monitor frequency, phases, and performance behavior.

It is also possible that the elements are connected based on the principle of a crossbar, T-switch, matrix switch, reversing switch, selector, crossover or matrix switch, i.e. that a control unit is used to switch various signal sources, preferably resonators, through to one or several consumers, preferably plasma sources. It is also possible that this switching process takes place in a time-division and/or space-division multiplexer. It is also possible that the superposition principle is used in combination with the preferred crossbar principle to preferably temporarily superpose individual resonators, preferably in order to have preferably dedicated plasma sources generate or maintain breakdown voltages or working points by targeted temporal or spatial superposition. In other words: it is possible to actuate plasma sources in a targeted manner, for example by combining the superposition principle, time-division multiplexing, and the crossbar principle.

It is also possible that the plasma source is integrated in the resonator. The resonator can also be a part of the plasma source. The introduction means can also be in a direct operative connection without a detour via the resonator. The plasma source may include the resonator itself or be a part of the resonator.

It is also possible that the plasma source is completely integrated into a region of the waveguide extending between the first and second coupling means. The waveguide may extend along any route through space, e.g. meandering. For example, introduction is on the left side of the plasma source, extraction on the right, and it is preferred that the plasma source is contacted on both sides using waveguides, and that energy is introduced or extracted, respectively, at the waveguides.

It is also possible that the waveguide extends continuously between the first and second coupling means and that the plasma source is positioned in the path of the waveguide. The term 'continuous' does not mean here that it is the same type and/or dielectric at every point of the waveguide. Instead, path sections of different designs are conceivable, and 'continuous' means that one and the same wave propagates along a continuous path.

It is also possible that the resonator is a microwave resonator, so that it generates electromagnetic waves in the typical frequency range of microwaves. It is also possible that microwaves in the range from 1 to 300 GHz, preferably from 1 to 100 GHz, more preferably from 1 to 50 GHz, and even more preferably from 1 to 10 GHz are generated in the resonator.

It is also possible that the resonator includes a cavity resonator or a cavity resonator descendant. It is also possible that the resonator includes a klystron or a klystron descendant. It is also possible that the resonator includes an electron-beam tube or an electron-beam tube descendant. It is also possible that the resonator includes a Gunn diode or a Gunn diode descendant. It is also possible that the resonator includes an avalanche diode or an avalanche diode descendant such as an IMPATT, TRAPATT, suppressor, Zener diode, or an avalanche photodiode. It is also possible that the resonator includes a DOVETT diode or a DOVETT diode descendant, such as a BARITT diode. It is also possible that the introduction means and the resonator are combined in one component and/or interact so closely that it is preferred that they cannot and/or need not be viewed as separate components.

It is also possible that the plasma source is designed as a hollow space with an opening for gas supply and gas discharge. This would have the advantage that the plasma could additionally perform mechanical work such as selectively machine off or shape surfaces of workpieces.

It is also possible that the plasma source comprises a gas supply that is connected to a first end of the hollow-cylindrical tube.

It is also possible that the plasma source comprises a gas supply that is not connected to a first end of the hollow-cylindrical tube but supplies the gas between both ends of the tube, preferably through inlet holes, inlet nozzles, or gas direction formers arranged in an annular shape and defined by the respective design of the interior surface.

It is also possible that this gas supply is not fed with gas one-time but regularly, that regular supply with gas is preferably part of the regular operating state and expressly not for one-time technological set-up.

It is also possible that the plasma source comprises a hollow-cylinder shaped tube the longitudinal axis of which extends perpendicular to the direction of propagation of the microwaves inside the microwave resonator.

It is also possible that a rectangular section through the hollow-cylinder shaped tube is—not necessarily exactly, but typically—the section of a polygon, square, triangle, an ellipse or a rectangle, the area of said section representing or resembling the inner portion of the hollow-cylinder shaped tube.

It is also possible that the longitudinal axis of the hollow-cylinder shaped tube that otherwise is preferably perpendicular to the direction of propagation of the microwaves deviates from the right angle.

It is also possible that the active element includes a transistor. In a preferred embodiment, the transistor works in positive feedback mode to use the frequency and phase for correctly timing the introduction. It is also conceivable to use the non-linearity of the transistor to prevent impermissible oscillation so that the non-linearity acts as negative feedback despite the wiring for positive feedback and thus performs a certain regulatory function. It is also conceivable to distribute the influences of positive and negative feedback over separate components or separate component parts and to let these act in combination on the resonator, e.g. via other coupling points, for example.

It is also possible that the waveguide includes a conductor that carries the electrical potential of the wave which is plated through and operatively connected for energy supply and energy extraction.

It is also possible that the first coupling means is positioned outside a dedicated point in a section of the waveguide wherein said dedicated point is at a spacing from the first line termination and the following convention applies to this spacing: Spacing=Integral multiple of one-half wavelength+one fourth of the wavelength. Wavelength means the wavelength of the standing wave in the resonator that is typical of the respective dimensioning of the resonator, where, for example, the length of the path across all sections of the waveguide and the magnitude of the plasma source influence the emerging wavelength.

The first coupling means for energy introduction is consequently positioned at that point of a waveguide path the distance of which from a line termination is different from the sum total of one fourth of the wavelength and an integral multiple of half the wavelength; the path is defined a the sum total of all path sections starting from the first line termination with reflection via waveguide sections, plasma source, another waveguide section to the second line termination for reflection, where the path ends.

The invention describes a method for generating a plasma by regulated and/or controlled introduction of energy into a resonator including a plasma source with the following process steps:

a) Extraction of energy in the form of a temporally and/or spectrally modulated signal with direct/indirect information about the current oscillation state at a second coupling means of the resonator;

b) Supply of the signal to an active element;

c) Amplification of the signal by the active element depending on the oscillation state of the resonator;

d) Supply of the amplified and temporally and/or spectrally modulated signal as supply energy to the resonator at a first coupling means;

wherein the plasma source is positioned between the first and the second coupling means.

The advantage of this method is that it improves the performance of the microwave plasma sources with respect to plasma-dependent frequency correction and the feedback required for the oscillator. Further advantages result from adjusting the plasma load. Performance, efficiency, stability of oscillation, and reliability are also clearly improved.

It is also possible that electrical output is determined as a physical parameter of the plasma source.

It is further possible that an electric current, the temperature, the static and/or dynamic pressure, a magnetic field, an electric voltage, an electric field, a luminous intensity, a particle speed, or a force is determined as a physical parameter of the plasma source. Likewise, it is possible that the above variables change their magnitude as a function of time and are thus dynamic variables. It is also possible that the direction vectors and/or their change over time are collected of the above variables, which are not scalar variables. It is also possible that variables derived from the above variables are detected, e.g. that a resistance is derived from current and voltage, or the frequency is derived from an AC resistance of a capacitance.

It is also possible to determine a time-dependent, i.e. dynamic, complex resistance of a dipole. A dipole in this meaning may be, for example, the plasma source, the resonator, or the introduction means, or a series circuit of these elements. This advantageously results in predeterminability or recognizability based on learned or known points and patterns in the frequency and/or time range of the complex resistance.

It is also possible to store the required connection between controlled variable and manipulated variable retrievably in a lookup table (LUT). The advantage is fast access without delay due to calculation time.

It is also possible to solve the control tasks using calculation methods stored in FPGAs, a microcontroller or microprocessor or using a combination of some or all of the elements mentioned above (including LUT interpolation).

It is also possible that the process steps a) to d) are repeated within a predefinable time interval. It is also possible that the process steps a) to d) run continuously. It is also possible that the process steps a) to d) do not run continuously but rather at discrete points in time, for example, due to digital processing.

It is also possible that the repeating time interval is smaller than 1 s and preferably even smaller than 0.1 s.

BRIEF DESCRIPTION OF THE DRAWINGS

The invention is explained in greater detail with reference to the drawings and the description below.

In the drawings.

DESCRIPTION OF SPECIFIC EMBODIMENTS OF THE INVENTION

Figure 1:
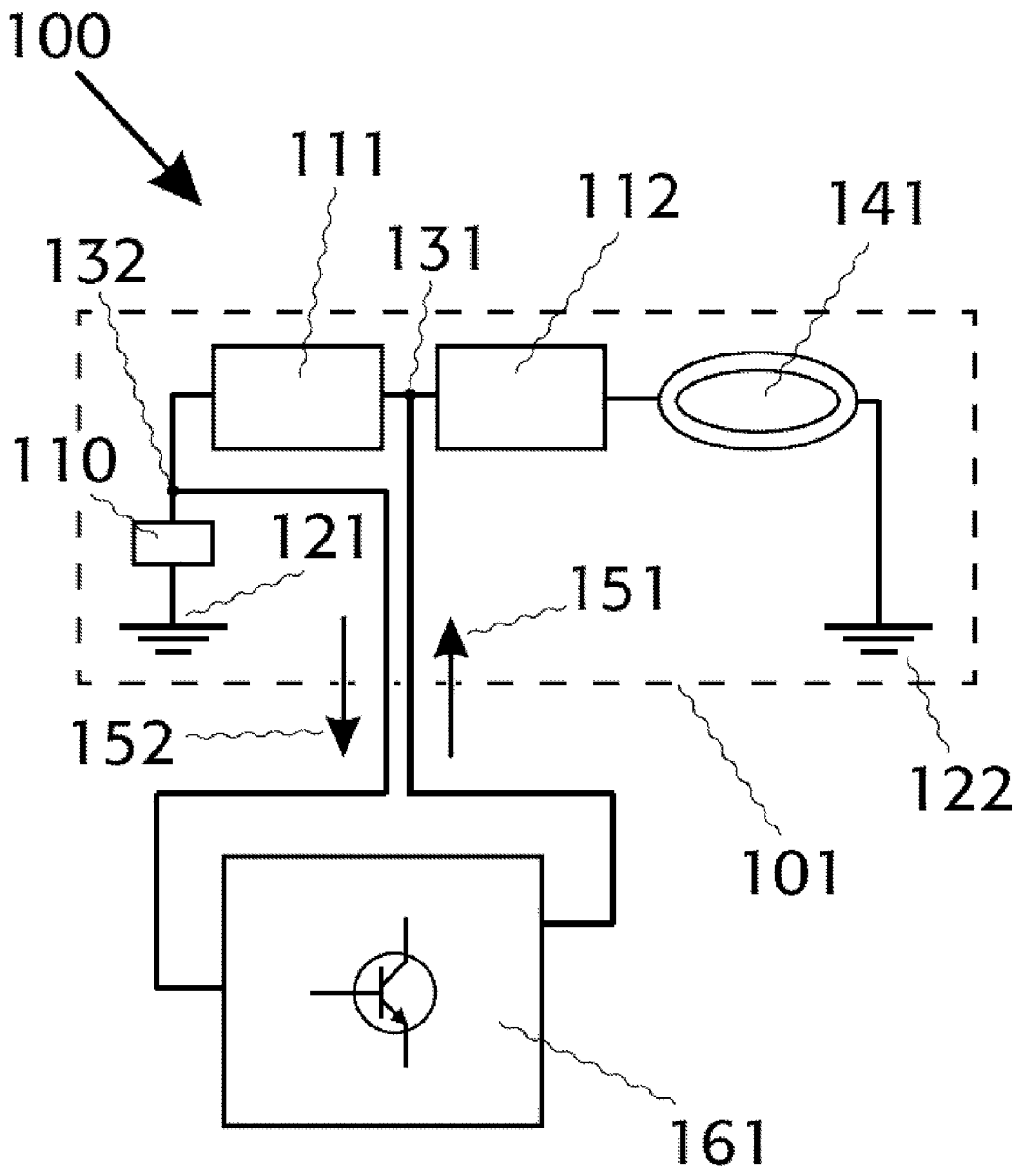
FIG. 1 shows a conventional oscillator device for state-of-the-art generation of a plasma for microwave plasma sources.

FIG. 1 shows a conventional device 100 for state-of-the-art generation of a plasma 141. The dashed line 101 marks the border of the resonator concept according to the state of the art. 121 and 122 are line terminations that lead to the reflection of the electromagnetic wave and thus represent the basis for oscillation in the resonator 101, symbolized as electrical ground. The standing wave builds up from the first line termination 121 along the waveguide sections 110, 111, 112 through the plasma 141 to the second line termination 122; its antinode, energy maximum is formed on the site of the plasma source 141 because the greatest field strength for igniting and maintaining the plasma is needed there. The coupling point 132 is a contacting of the waveguide 110, 111 such that energy is extracted 152 to be conducted to the active element 161. The active element, preferably including a transistor that is preferably wired for positive feedback, therefore receives information on frequency and phase in the resonator 101, amplifies the energy and conducts the energy 151 using the coupling point 131 positioned near the waveguide 111, 112, to the resonator 101 to advance the oscillation. It is typical of this resonator concept according to the state of the art that the coupling points for energy introduction 131 and energy extraction 132 are only positioned between the first line termination 121 and the plasma source 141 and not between the plasma source 141 and the second line termination 122 as well.

Figure 2:
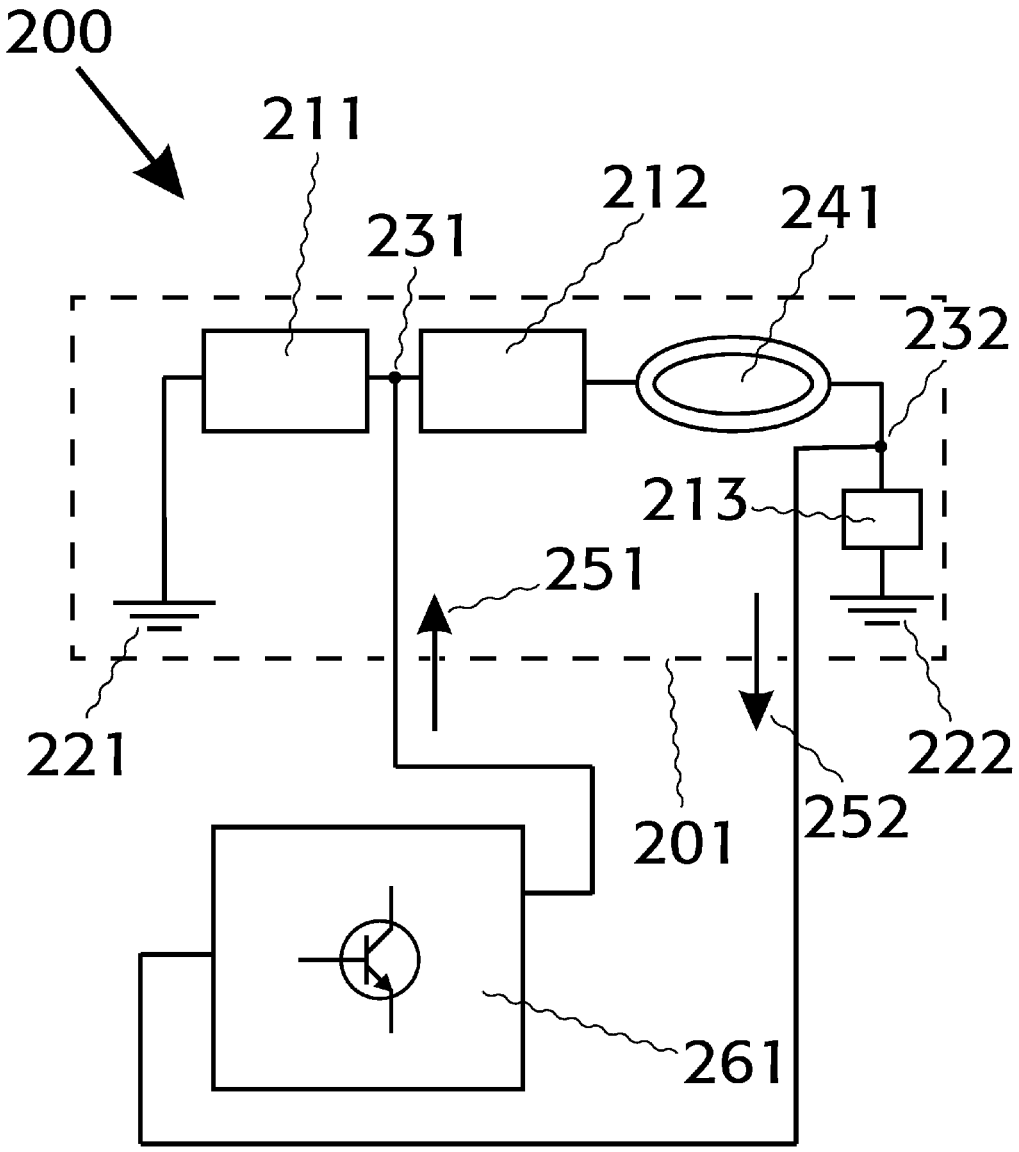
FIG. 2 shows an oscillator according to the invention for generating a plasma for microwave plasma sources.

FIG. 2 shows the device according to the invention 200 for generating a plasma 241. The dashed line 201 marks the border of the resonator concept according to the invention. 221 and 222 are line terminations that lead to the reflection of the electromagnetic wave and thus represent the basis for oscillation in the resonator 201, symbolized as electrical ground. The standing wave builds up from the first line termination 221 along the waveguide sections 211, 212, 241 through the plasma 241 along the waveguide 213 to the second line termination 222; its antinode, energy maximum is formed on the site of the plasma source 241 because the greatest field strength for igniting and maintaining the plasma is needed there.

A section 211, 212, 241, 213 of the waveguiding can be recognized in that it is delimited by the coupling point 231, 232, the plasma source 241, or the line termination 221, 222, meaning that the homogeneity of waveguiding changes or is interrupted along the propagation path of the wave.

Extraction 252 of energy from the resonator 201 takes place at the coupling point 232, and supply 251 of energy to the resonator 201 takes place at coupling point 231, wherein the plasma source 241 is positioned between the introduction point 231 and the extraction point 232.

The active element 261 preferably includes a transistor, preferably wired for positive feedback, to amplify the supplied signal 252. It is also possible to use another active element that does not operate under positive but under negative feedback to improve the stability of the oscillation process in the resonator and therefore in the plasma. It is also possible to operatively connect this other active element 261 with another coupling point for extraction 232 from the resonator 201 and/or to also connect this other element with another coupling point for introduction 231. In this way, the options for controlling or even closed-loop controlling the oscillation state in the resonator and the plasma can be improved. Waveguiding outside the hollow space of the plasma source is preferably performed by monolithic microwave integrated circuits (MMIC) with strip line (micro strip). Other line types are conceivable in principle, such as coaxial cables, ribbon conductors, or waveguide tubes. It is also conceivable to design a smaller volume of the plasma source as a cavity, i.e. to form spatial sections of waveguiding using a non-gaseous dielectric that introduces energy into the plasma towards the gaseous range and thus initiates and drives the plasma.

The coupling point for introduction into the resonator with respect to the conduction path of the plasma wave in the resonator is preferably located outside the lambda/fourth range because there is an antinode at lambda/fourth plus an integral multiple of half the wavelength.

The input signal would therefore have to have an amplitude corresponding to the antinode. With introduction outside the lambda/fourth range, this is no longer required and therefore advantageous.

It is preferred that the coupling point is designed as an electric line contacted through to the waveguide. Other coupling types and combinations thereof are feasible that are based on other physical variables, e.g. coupling by a magnetic field, coupling by an electric field, coupling by electric voltage or electric current.

The coupling point for extracting energy could even detect other physical states, such as luminous power, pressure, temperature, magnetic field strength, stray fields and other physical variables that are directly or indirectly derived from states in the resonator. It is therefore conceivable that a coupling point for extraction does not directly contact the waveguiding of the plasma wave but is remote from the waveguiding of the plasma wave. The plasma wave is defined as that standing wave in the resonator that drives the plasma source. It is also conceivable that a coupling point for extraction is in or at the plasma source and that the feedback information 252 is obtained directly or indirectly from the state of the plasma. It is also possible that the above principle of non-direct contact with the waveguiding applies similarly to the coupling point for introduction.

What is claimed is:

1. A device for generating a plasma, comprising:

a plasma source designed as a hollow space;

a resonator that includes a waveguide and the plasma source, wherein the waveguide is operatively connected with the plasma source and wherein the resonator is defined between a first line termination and a second line termination;

a first coupling means for energy introduction and a second coupling means for energy extraction, wherein each coupling means is in an energy- and/or signal-carrying operative connection with the waveguide; and an active element for energy supply to the resonator, which is operatively connected with the first coupling means and the second coupling means;

characterized in that the first coupling means and the second coupling means are at opposite sides of the plasma source, such that a portion of a standing wave in the resonator that passes through the plasma source exits through the second coupling means, and is amplified by the active element to provide positive feedback to the resonator via the first coupling means wherein the first coupling means is between the first line termination and the plasma source at a distance from the first line termination which is other than the sum total of one fourth of a wavelength of the standing wave and an integral multiple of half the wavelength of the standing wave.

2. The device according to claim 1, wherein:

the plasma source is completely integrated into a section of the waveguide that extends between the first coupling means and the second coupling means.

3. The device according to claim 1, wherein:

the waveguide extends continuously between the first coupling means and the second coupling means and that the plasma source is positioned in this continuously extending section of the waveguide.

4. The device according to claim 1, wherein:

the resonator is a microwave resonator.

5. The device according to claim 4, wherein:

the plasma source comprises a waveguide tube with a longitudinal axis that extends perpendicular to the direction of propagation of the microwaves inside the microwave resonator.

6. The device according to claim 1, wherein:

the active element includes a transistor.

7. The device according to claim 1, wherein:

the waveguide includes an electrical conductor, and the electrical conductor directly contacts the first coupling means and/or directly contacts the second coupling means.

8. A method for generating a plasma, by introduction of energy into a resonator including a plasma source, a first and a second coupling means, wherein the resonator is defined between a first line termination and a second line termination, wherein the first and the second coupling means are at opposite sides of the plasma source, and wherein the method also comprises:

a) extraction of energy carried by a portion of a standing wave in the resonator that passes through the plasma source, the energy being in the form of a modulated signal with information about the current oscillation state at the second coupling means of the resonator;

b) supply of the signal to an active element;

c) amplification of the signal by the active element depending on the oscillation state in the resonator; and d) supply of the amplified signal as supply energy to the resonator at the first coupling means which is at a distance from the first line termination which is other than a sum total of an integer multiple of half of a wavelength of the standing wave and one fourth of the wavelength of the standing wave.

9. A method of generating plasma, comprising:

generating a standing wave in a resonator having a waveguide defined between a first line termination and a second line termination and a plasma source at least partially integrated into the waveguide;

extracting from the resonator energy carried by a portion of the standing wave, following transmission of the portion through the plasma source;

amplifying the extracted energy; and coupling the amplified extracted energy into the resonator as a feedback for maintaining the standing wave;

wherein the extraction and the coupling are executed at opposite sides of the plasma source, wherein the coupling is executed between the first line termination and the plasma source at a distance from the first line termination which is other than $n\lambda/2+\lambda/4$, wherein n is an integer and wherein $\lambda$ is a wavelength of the standing wave.

* * * * *